US012808567B2

(12) United States Patent
Ishimura et al.

(10) Patent No.: US 12,808,567 B2
(45) Date of Patent: Nov. 24, 2026

(54) AIR-CONDITIONING APPARATUS

(71) Applicant: Mitsubishi Electric Corporation, Tokyo (JP)

(72) Inventors: Shohei Ishimura, Tokyo (JP); Toshimitsu Kamada, Tokyo (JP); Masakazu Kondo, Tokyo (JP); Atsushi Kawashima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 106 days.

(21) Appl. No.: 18/839,447

(22) PCT Filed: Mar. 14, 2022

(86) PCT No.: PCT/JP2022/011211

§ 371 (c)(1),
(2) Date: Aug. 19, 2024

(87) PCT Pub. No.: WO2023/175656

PCT Pub. Date: Sep. 21, 2023

(65) Prior Publication Data

US 2025/0155154 A1 May 15, 2025

(51) Int. Cl.
*F24F 11/84* (2018.01)
*F24F 11/42* (2018.01)

(52) U.S. Cl.
CPC ..... *F24F 11/84* (2018.01); *F24F 11/42* (2018.01)

(58) Field of Classification Search
CPC . F24F 11/84; F24F 11/42; F25B 41/42; F25B 41/30; F25B 2313/0315;
(Continued)

(56) References Cited

U.S. PATENT DOCUMENTS 10,024,588 B2 * 7/2018 Tamura ..... F25B 47/022
2015/0292789 A1 * 10/2015 Takenaka ..... F25D 21/006 62/140
(Continued)

FOREIGN PATENT DOCUMENTS

CN 111201410 A * 5/2020 ..... F25B 5/02
CN 112444000 A * 3/2021 ..... F25B 47/025
(Continued)

OTHER PUBLICATIONS

International Search Report and Written Opinion mailed on Apr. 5, 2022, received for PCT Application PCT/JP2022/011211, filed on Mar. 14, 2022, 8 pages including English Translation.

*Primary Examiner* — Kun Kai Ma
(74) *Attorney, Agent, or Firm* — XSENSUS LLP

(57) ABSTRACT

An air-conditioning apparatus includes configured to, during a heating-defrosting operation mode in which one of a first outdoor heat exchanger and a second outdoor heat exchanger connected in parallel with each other is defrosted as a target to be defrosted, compare a first condensing temperature obtained when the target to be defrosted is switched from one to the other with a second condensing temperature obtained when a normal heating operation mode in which the first outdoor heat exchanger and the second outdoor heat exchanger operate as evaporators is switched to the heating-defrosting operation mode, reduce, when the first condensing temperature is less than the second condensing temperature, an opening degree of a flow control device smaller than an initial opening degree, and increase, when the first condensing temperature is greater than the second condensing temperature, the opening degree larger than the initial opening degree.

8 Claims, 8 Drawing Sheets

(58) Field of Classification Search
CPC ..... F25B 47/022; F25B 2313/0253; F25B 2500/31; F25B 2600/2501; F25B 2700/2106; F25B 47/025; F25B 49/02; F25B 13/00
See application file for complete search history.

(56) References Cited

U.S. PATENT DOCUMENTS

| | | | | |
|---|---|---|---|---|
| 2016/0370045 | A1* | 12/2016 | Takenaka | F28D 1/0443 |
| 2017/0370627 | A1* | 12/2017 | Takenaka | F24F 11/89 |
| 2022/0107123 | A1 | 4/2022 | Ishimura et al. | |
| 2022/0260292 | A1 | 8/2022 | Kawashima et al. | |

FOREIGN PATENT DOCUMENTS

| | | | | | |
|---|---|---|---|---|---|
| CN | 112444001 | A | * | 3/2021 | F25B 13/00 |
| CN | 213841110 | U | * | 7/2021 | |
| EP | 3006866 | A1 | * | 4/2016 | F25D 21/002 |
| EP | 3062031 | A1 | * | 8/2016 | F24F 11/42 |
| GB | 2552891 | A | * | 2/2018 | F25B 47/02 |
| JP | 2016-106211 | A | | 6/2016 | |
| JP | 2019184207 | A | * | 10/2019 | |
| JP | 6661843 | B1 | * | 3/2020 | F25B 49/02 |
| JP | 7112057 | B1 | * | 8/2022 | F24F 11/42 |
| WO | WO-2014083867 | A1 | * | 6/2014 | F25D 21/006 |
| WO | WO-2015059945 | A1 | * | 4/2015 | F25B 47/022 |
| WO | 2015/129080 | A1 | | 9/2015 | |
| WO | WO-2016113851 | A1 | * | 7/2016 | F25B 13/00 |
| WO | WO-2017199289 | A1 | * | 11/2017 | F25B 47/022 |
| WO | WO-2019224945 | A1 | * | 11/2019 | F24F 11/41 |
| WO | WO-2020194435 | A1 | * | 10/2020 | F25B 49/02 |
| WO | WO-2020208776 | A1 | * | 10/2020 | F24F 11/86 |
| WO | 2021/038660 | A1 | | 3/2021 | |

* cited by examiner

AIR-CONDITIONING APPARATUS

CROSS-REFERENCE TO RELATED APPLICATION

This application is a national stage application, pursuant to 35 U.S.C. § 371, of International Patent Application No. PCT/JP2022/011211, filed Mar. 14, 2022, the entire contents of which are incorporated herein by reference.

TECHNICAL FIELD

The present disclosure relates to an air-conditioning apparatus having a function that removes frost that attaches on an outdoor heat exchanger.

BACKGROUND ART

In recent years, from the viewpoint of the global environment protection, there have been an increasing number of cases in which heat pump type air-conditioning apparatuses using air as a heat source have been used in cold climate areas in place of boiler type heaters that perform heating by burning fossil fuel. Such a heat pump type air-conditioning apparatus is configured to perform heating more efficiently because heat is supplied from the air in addition to electrical input to a compressor.

However, in the heat pump type air-conditioning apparatus, the lower the outdoor temperature, the more likely frost will form on an outdoor heat exchanger that operates as an evaporator and exchanges heat between an outdoor air and refrigerant. Thus, defrosting needs to be performed to melt frost that attaches on the outdoor heat exchanger. Examples of defrosting methods include a method in which the flow direction of refrigerant is reversed in a heating operation to supply the refrigerant from the compressor to the outdoor heat exchanger. However, this method has a problem in that heating a room may be stopped during defrosting, impairing comfortability in the room.

To solve this problem, Patent Literature 1 discloses an air-conditioning apparatus in which the outdoor heat exchanger is divided into multiple outdoor heat exchangers and that is configured to operate in a heating-defrosting operation mode. The heating-defrosting operation mode is an operation mode in which, while one of the outdoor heat exchangers is being defrosted by causing part of the refrigerant discharged from the compressor to flow into the outdoor heat exchanger, the other outdoor heat exchangers operate as evaporators. The outdoor heat exchangers are defrosted by turns in the heating-defrosting operation mode, thus achieving continuous heating without using the same refrigeration cycle flow as that in a cooling operation.

In addition, in the air-conditioning apparatus of Patent Literature 1, when one of the outdoor heat exchangers is defrosted, a flow control device provided to a bypass pipe is adjusted on the basis of the evaporating pressures of the other outdoor heat exchangers operating as evaporators and the driving frequency of the compressor. When the operation mode is switched to the heating-defrosting operation mode, the opening degree of the flow control device is adjusted such that refrigerant corresponding to an increase in flow rate of the refrigerant is caused to flow into the outdoor heat exchanger to be defrosted. In this way, the air-conditioning apparatus of Patent Literature 1 attempts to maintain the flow rate of the refrigerant to be supplied to the indoor heat exchanger and prevent a reduction in heating capacity.

CITATION LIST

Patent Literature

Patent Literature 1: International Publication No. WO 2020/194435

SUMMARY OF INVENTION

Technical Problem

However, during the heating-defrosting operation mode, volume efficiency of the compressor is reduced in some cases because of an increase in the difference between high and low pressures in the refrigeration cycle. Consequently, in Patent Literature 1, there are cases where the flow rate of the refrigerant becomes smaller than expected and thus heating capacity is reduced. In such a case, the blowout temperature of the indoor unit is lowered and the comfortability in the room is impaired.

The present disclosure has been made to overcome the abovementioned problem, and has an object to provide an air-conditioning apparatus capable of preventing the temperature of air blown out into a room in the heating-defrosting operation mode from changing from that in a heating operation performed before the operation mode is switched to the heating-defrosting operation mode, and thus capable of improving comfortability in the room.

Solution to Problem

An air-conditioning apparatus according to an embodiment of the present disclosure includes a circuit in which a compressor, a flow switching device, an indoor heat exchanger, a pressure reducing device, and a first outdoor heat exchanger and a second outdoor heat exchanger connected in parallel with each other are connected by pipes and through which refrigerant flows, a bypass circuit having a bypass pipe that connects a discharge side of the compressor to a point between the flow switching device and the first outdoor heat exchanger and to a point between the flow switching device and the second outdoor heat exchanger and allows part of the refrigerant discharged from the compressor to be diverted into the bypass pipe and flow through the bypass pipe, a flow control device provided to the bypass pipe and configured to adjust a flow rate of the refrigerant flowing through the bypass pipe, and a controller configured to control the flow switching device, the pressure reducing device, and the flow control device. The air-conditioning apparatus is configured to operate in a normal heating operation mode in which the first outdoor heat exchanger and the second outdoor heat exchanger operate as evaporators and in a heating-defrosting operation mode in which one of the first outdoor heat exchanger and the second outdoor heat exchanger is defrosted as a target to be defrosted and the other outdoor heat exchanger operates as an evaporator. The controller is configured to, during the heating-defrosting operation mode, compare a first condensing temperature obtained when the target to be defrosted is switched from one to the other with a second condensing temperature obtained when an operation mode is switched from the normal heating operation mode to the heating-defrosting operation mode, reduce, when the first condensing temperature is less than the second condensing temperature, an opening degree of the flow control device smaller than an initial opening degree being set when the normal heating operation mode is shifted to the heating-defrosting operation mode, and increase, when the first condensing temperature is greater than the second condensing temperature, the opening degree of the flow control device larger than the initial opening degree.

Advantageous Effects of Invention

The controller of the air-conditioning apparatus according to an embodiment of the present disclosure is configured to, when, during the heating-defrosting operation mode, the condensing temperature of the indoor heat exchanger becomes lower than the condensing temperature obtained when a heating operation mode is switched to the heating-defrosting operation mode, reduce the opening degree of the flow control device smaller than the initial opening degree to increase the flow rate of the refrigerant to be supplied to the indoor heat exchanger. With this configuration, the air-conditioning apparatus according to an embodiment of the present disclosure is configured to prevent the temperature of air blown out into a room in the heating-defrosting operation mode from changing from that in a heating operation performed before the operation mode is switched to the heating-defrosting operation mode, and thus comfortability in the room is improved.

DESCRIPTION OF EMBODIMENTS

Embodiment 1

Figure 1:
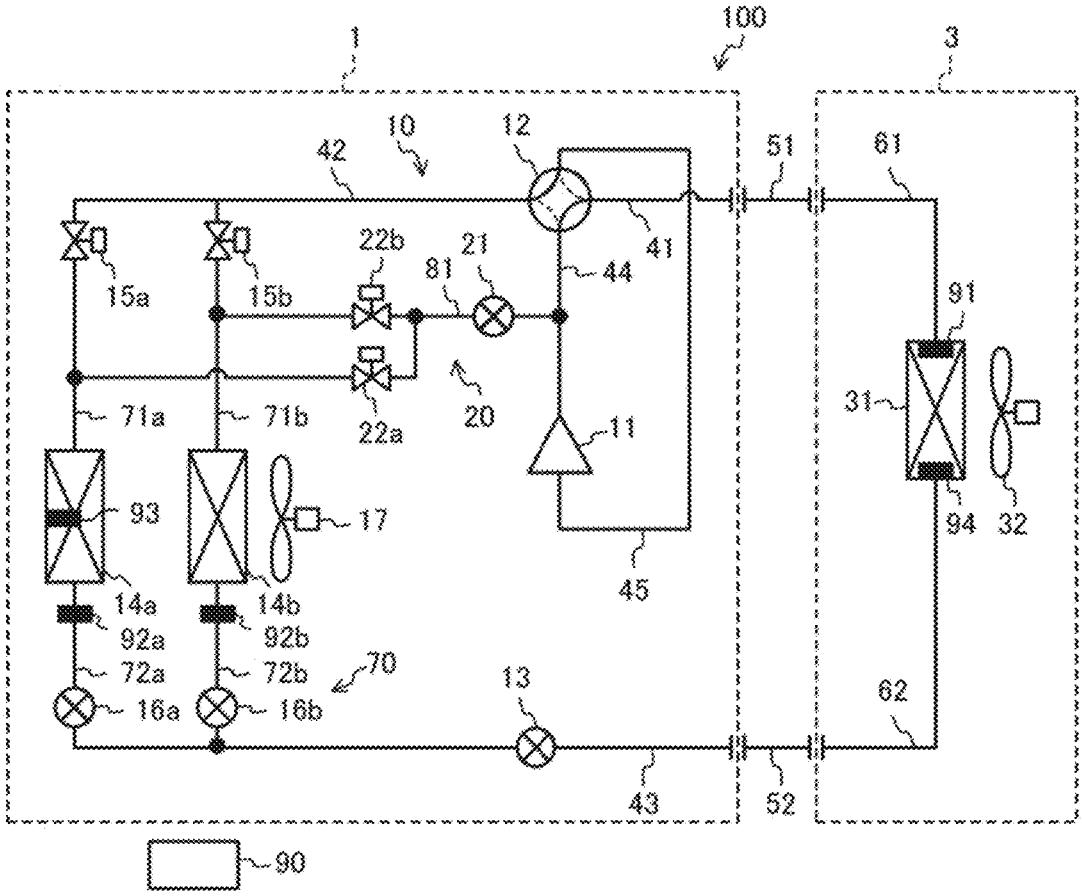
FIG. 1 is a circuit diagram illustrating an air-conditioning apparatus according to Embodiment 1.

An embodiment of an air-conditioning apparatus 100 according to the present disclosure will be described below with reference to the drawings. FIG. 1 is a circuit diagram illustrating the air-conditioning apparatus 100 according to Embodiment 1. The air-conditioning apparatus 100 is an apparatus configured to condition air in an indoor space, and includes an outdoor unit 1, an indoor unit 3, and a controller 90, as shown in FIG. 1.

The outdoor unit 1 is a device that is, for example, installed outdoors and configured to supply a heating energy or a cooling energy to the indoor unit 3. The outdoor unit 1 includes a compressor 11, a flow switching device 12, a pressure reducing device 13, a first outdoor heat exchanger 14*a*, a second outdoor heat exchanger 14*b*, a first opening and closing device 15*a*, a second opening and closing device 15*b*, a first supplementary pressure reducing device 16*a*, a second supplementary pressure reducing device 16*b*, and an outdoor fan 17. The outdoor unit 1 further includes a flow control device 21, a first bypass opening and closing device 22*a*, and a second bypass opening and closing device 22*b*. In addition, the outdoor unit 1 includes a first outdoor pressure sensor 92*a*, a second outdoor pressure sensor 92*b*, and an outdoor temperature sensor 93. Each of the devices in the outdoor unit 1 will be described later.

The outdoor unit 1 includes an outdoor unit pipe 41, an outdoor unit pipe 42, an outdoor unit pipe 43, a discharge pipe 44, a suction pipe 45, parallel pipes 70, and a bypass pipe 81. The outdoor unit pipe 41 connects the flow switching device 12 and an extension pipe 51, which will be described later. The outdoor unit pipe 42 connects the flow switching device 12 to the first opening and closing device 15*a* and the second opening and closing device 15*b*. The outdoor unit pipe 42 is branched at its end at which the first opening and closing device 15*a* and the second opening and closing device 15*b* are arranged, and respective branched pipes are connected to the first opening and closing device 15*a* and the second opening and closing device 15*b*. The outdoor unit pipe 43 connects the first supplementary pressure reducing device 16*a* and the second supplementary pressure reducing device 16*b* to an extension pipe 52, which will be described later. The outdoor unit pipe 43 is branched at its end at which the first supplementary pressure reducing device 16*a* and the second supplementary pressure reducing device 16*b* are arranged, and respective branched pipes are connected to the first supplementary pressure reducing device 16*a* and the second supplementary pressure reducing device 16*b*.

The discharge pipe 44 connects a discharge side of the compressor 11 and the flow switching device 12. The suction pipe 45 connects a suction side of the compressor 11 and the flow switching device 12.

The parallel pipes 70 include a first compressor side pipe 71*a*, a second compressor side pipe 71*b*, a first pressure reducing device side pipe 72*a*, and a second pressure reducing device side pipe 72*b*. The first compressor side pipe 71*a* and the second compressor side pipe 71*b* are provided closer to the compressor 11 and the flow switching device 12 than are the first pressure reducing device side pipe 72*a* and the second pressure reducing device side pipe 72*b*, which are provided closer to the pressure reducing device 13 than are the first compressor side pipe 71*a* and the second compressor side pipe 71*b*. The first compressor side pipe 71*a* connects the first opening and closing device 15*a* and the first outdoor heat exchanger 14*a*. The second compressor side pipe 71*b* connects the second opening and closing device 15*b* and the second outdoor heat exchanger 14*b*. The first pressure reducing device side pipe 72*a* connects the first outdoor heat exchanger 14*a* and the first supplementary pressure reducing device 16*a*. The second pressure reducing device side pipe 72*b* connects the second outdoor heat exchanger 14*b* and the second supplementary pressure reducing device 16*b*. That is, a set of the first compressor side pipe 71*a* and the first pressure reducing device side pipe 72*a* and a set of the second compressor side pipe 71*b* and the second pressure reducing device side pipe 72*b* are connected in parallel with each other and connected to the outdoor unit pipe 42 and the outdoor unit pipe 43.

The bypass pipe 81 is branched off from a point at the discharge pipe 44 and is connected to the first compressor side pipe 71*a* and the second compressor side pipe 71*b* and bypasses the flow switching device 12. The bypass pipe 81 is branched at its end at which the first compressor side pipe 71*a* and the second compressor side pipe 71*b* are arranged, and respective branched pipes are connected to the first compressor side pipe 71*a* and the second compressor side pipe 71*b*. That is, the bypass pipe 81 connects the discharge side of the compressor 11 to a point between the flow switching device 12 and the first outdoor heat exchanger 14*a* and to a point between the flow switching device 12 and the first outdoor heat exchanger 14*a*. Part of the refrigerant discharged from the compressor 11 is diverted to and flows through the bypass pipe 81. Note that, the bypass pipe 81 may be formed to connect the outdoor unit pipe 41 to the first compressor side pipe 71*a* and the second compressor side pipe 71*b*.

The indoor unit 3 is a device that is, for example, installed in a room and configured to condition air in the room. The indoor unit 3 includes an indoor heat exchanger 31 and an indoor fan 32. The indoor unit 3 further includes an indoor pressure sensor 91 and an indoor temperature sensor 94. Each of the devices in the indoor unit 3 will be described later.

The indoor unit 3 includes an indoor unit pipe 61 and an indoor unit pipe 62. The indoor unit pipe 61 connects the extension pipe 51 and the indoor heat exchanger 31. The indoor unit pipe 62 connects the indoor heat exchanger 31 and the extension pipe 52.

The extension pipe 51 and the extension pipe 52 are provided outside the outdoor unit 1 and the indoor unit 3, and connect the outdoor unit 1 and the indoor unit 3. Note that, although a case where the single outdoor unit 1 and the single indoor unit 3 are provided is described in Embodiment 1, two or more outdoor units 1 may be provided and alternatively two or more indoor units 3 may be provided.

The compressor 11 is configured to suck refrigerant in a low-temperature and low-pressure state, compress the sucked refrigerant into a high-temperature and high-pressure state, and discharge the refrigerant. The flow switching device 12 is configured to switch directions in which the refrigerant flows in the refrigerant circuit, and is, for example, a four-way valve. The pressure reducing device 13 is a pressure reducing valve or an expansion valve configured to reduce the pressure of the refrigerant and expands the refrigerant. The pressure reducing device 13 is, for example, an electronic expansion valve whose opening degree is adjustable. Although a case where the pressure reducing device 13 is provided in the outdoor unit 1 is described in Embodiment 1, the pressure reducing device 13 may be provided in the indoor unit 3.

The first outdoor heat exchanger 14*a* is provided between the first compressor side pipe 71*a* and the first pressure reducing device side pipe 72*a*. The second outdoor heat exchanger 14*b* is provided between the second compressor side pipe 71*b* and the second pressure reducing device side pipe 72*b*. That is, the first outdoor heat exchanger 14*a* and the second outdoor heat exchanger 14*b* are connected in parallel with each other. The first outdoor heat exchanger 14*a* and the second outdoor heat exchanger 14*b* exchange heat between the refrigerant and, for example, an outdoor air. The first outdoor heat exchanger 14*a* and the second outdoor heat exchanger 14*b* are configured to operate as condensers in a cooling operation and operate as evaporators in a heating operation. Although a case where two outdoor heat exchangers are provided is described in Embodiment 1, three or more outdoor heat exchangers may be provided.

The first opening and closing device 15*a* is provided between the outdoor unit pipe 42 and the first compressor side pipe 71*a*. While the first opening and closing device 15*a* is opened, the refrigerant flows through the first outdoor heat exchanger 14*a*. While the first opening and closing device 15*a* is closed, the refrigerant does not flow between the outdoor unit pipe 42 and the first compressor side pipe 71*a*. The second opening and closing device 15*b* is provided between the outdoor unit pipe 42 and the second compressor side pipe 71*b*. While the second opening and closing device 15*b* is opened, the refrigerant flows through the second outdoor heat exchanger 14*b*. While the second opening and closing device 15*b* is closed, the refrigerant does not flow between the outdoor unit pipe 42 and the second compressor side pipe 71*b*. It is only required that the first opening and closing device 15*a* and the second opening and closing device 15*b* be capable of opening and closing a flow passage. The first opening and closing device 15*a* and the second opening and closing device 15*b* are each a solenoid valve, a four-way valve, a three-way valve, a two-way valve, or a similar device.

The first supplementary pressure reducing device 16*a* is provided between the first pressure reducing device side pipe 72*a* and the outdoor unit pipe 43. The second supplementary pressure reducing device 16*b* is provided between the second pressure reducing device side pipe 72*b* and the outdoor unit pipe 43. The first supplementary pressure reducing device 16*a* and the second supplementary pressure reducing device 16*b* are, for example, electronic expansion valves whose opening degrees are adjustable or fixed resistors, such as capillary tubes.

The outdoor fan 17 is configured to send an outdoor air to the first outdoor heat exchanger 14*a* and the second outdoor heat exchanger 14*b*. In Embodiment 1, a case where the single outdoor fan 17 sends an outdoor air to both the first outdoor heat exchanger 14*a* and the second outdoor heat exchanger 14*b* is described. However, two outdoor fans 17 may be arranged to send an outdoor air to the respective first outdoor heat exchanger 14*a* and second outdoor heat exchanger 14*b*.

The indoor heat exchanger 31 exchanges heat between the refrigerant and, for example, an indoor air. The indoor heat exchanger 31 is configured to operate as an evaporator in a cooling operation and operate as a condenser in a heating operation. The indoor fan 32 is configured to send an indoor air to the indoor heat exchanger 31.

The compressor 11, the flow switching device 12, the pressure reducing device 13, the first outdoor heat exchanger 14*a* and the second outdoor heat exchanger 14*b*, the first opening and closing device 15*a* and the second opening and closing device 15*b*, the first supplementary pressure reducing device 16*a* and the second supplementary pressure reducing device 16*b*, and the indoor heat exchanger 31 are connected by the outdoor unit pipes 41 to 43, the discharge pipe 44, the suction pipe 45, the extension pipes 51 and 52, the indoor unit pipes 61 and 62, and the parallel pipes 70 to form a main circuit 10 through which the refrigerant is circulated. The outdoor unit pipes 41 to 43, the discharge pipe 44, the suction pipe 45, the extension pipes 51 and 52, the indoor unit pipes 61 and 62, and the parallel pipes 70 correspond to the "pipes" of the present disclosure.

The flow control device 21 is provided to the bypass pipe 81 and is configured to adjust the flow rate of the refrigerant flowing in the bypass pipe 81. The first bypass opening and closing device 22*a* is provided to one branched pipe, among the branched pipes of the bypass pipe 81, to which the first compressor side pipe 71*a* is connected. While the first bypass opening and closing device 22*a* is opened, the refrigerant having passed through the bypass pipe 81 flows through the first outdoor heat exchanger 14*a*. While the first bypass opening and closing device 22*a* is closed, the refrigerant having passed through the bypass pipe 81 does not flow through the first outdoor heat exchanger 14*a*. The second bypass opening and closing device 22*b* is provided to the other branched pipe, among the branched pipes of the bypass pipe 81, to which the second compressor side pipe 71*b* is connected. While the second bypass opening and closing device 22*b* is opened, the refrigerant having passed through the bypass pipe 81 flows through the second outdoor heat exchanger 14*b*. While the second bypass opening and closing device 22*b* is closed, the refrigerant having passed through the bypass pipe 81 does not flow through the second outdoor heat exchanger 14*b*. It is only required that the first bypass opening and closing device 22*a* and the second bypass opening and closing device 22*b* be each capable of opening and closing a flow passage. The first bypass opening and closing device 22*a* and the second bypass opening and closing device 22*b* are each a solenoid valve, a four-way valve, a three-way valve, a two-way valve, or a similar device.

The flow control device 21, the first bypass opening and closing device 22*a*, and the second bypass opening and closing device 22*b* are connected by the bypass pipe 81 to form a bypass circuit 20 through which the refrigerant flows.

The first outdoor pressure sensor 92*a* is provided at the first pressure reducing device side pipe 72*a* and between the first outdoor heat exchanger 14*a* and the pressure reducing device 13, and is configured to detect the pressure of the refrigerant flowing in the first pressure reducing device side pipe 72*a*. The second outdoor pressure sensor 92*b* is provided at the second pressure reducing device side pipe 72*b* and between the second outdoor heat exchanger 14*b* and the pressure reducing device 13, and is configured to detect the pressure of the refrigerant flowing in the second pressure reducing device side pipe 72*b*.

When the first outdoor heat exchanger 14*a* and the second outdoor heat exchanger 14*b* operate as condensers, the first outdoor pressure sensor 92*a* serves as a sensor that detects a condensing pressure of the first outdoor heat exchanger 14*a* and the second outdoor pressure sensor 92*b* serves as a sensor that detects a condensing pressure of the second outdoor heat exchanger 14*b*. When the first outdoor heat exchanger 14*a* and the second outdoor heat exchanger 14*b* operate as evaporators, the first outdoor pressure sensor 92*a* serves as a sensor that detects an evaporating pressure of the first outdoor heat exchanger 14*a* and the second outdoor pressure sensor 92*b* serves as a sensor that detects an evaporating pressure of the second outdoor heat exchanger 14*b*.

Note that, the first outdoor pressure sensor 92*a* and the second outdoor pressure sensor 92*b* may be arranged on the suction side of the compressor 11 and detect a suction pressure. Furthermore, at a portion where the refrigerant is in a two-phase gas-liquid state, temperature sensors configured to detect the temperature of the refrigerant may be used in place of the first outdoor pressure sensor 92*a* and the second outdoor pressure sensor 92*b*. In such a case, values detected by the temperature sensors are each converted, as a saturation temperature, into a pressure of the refrigerant by the controller 90. The temperature of the refrigerant may be detected in a direct manner, in which the temperature sensor is in contact with the refrigerant, or in an indirect manner, in which the temperature of an outer surface of a pipe or a heat exchanger is detected.

The outdoor temperature sensor 93 is provided in the vicinity of the first outdoor heat exchanger 14*a*, and is configured to detect the temperature of the outdoor air. Specifically, the outdoor temperature sensor 93 is installed close to a location from which an outdoor air flows into the first outdoor heat exchanger 14*a* and installed a short distance away from the first outdoor heat exchanger 14*a*. Note that, the outdoor temperature sensor 93 may be provided in the vicinity of the second outdoor heat exchanger 14*b*.

The indoor pressure sensor 91 is provided to the indoor heat exchanger 31, and is configured to detect the pressure of the refrigerant flowing in the indoor heat exchanger 31. When the indoor heat exchanger 31 operates as a condenser, the indoor pressure sensor 91 serves as a sensor that detects a condensing pressure of the indoor heat exchanger 31. When the indoor heat exchanger 31 operates as an evaporator, the indoor pressure sensor 91 serves as a sensor that detects an evaporating pressure of the indoor heat exchanger 31. Note that, the indoor pressure sensor 91 may be provided on the discharge side of the compressor 11 and detect a discharge pressure. In addition, at a portion where the refrigerant is in a two-phase gas-liquid state, a temperature sensor configured to detect a condensing temperature of the refrigerant in the indoor heat exchanger 31 may be used in place of the indoor pressure sensor 91.

The indoor temperature sensor 94 is provided in the vicinity of the indoor heat exchanger 31, and is configured to detect the temperature of the indoor air. Specifically, the indoor temperature sensor 94 is installed at an indoor air inlet of the indoor unit 3, which is located a short distance away from the indoor heat exchanger 31.

For the refrigerant circulated through the refrigerant cycle, a chlorofluorocarbon refrigerant or a hydrofluoroolefin (HFO) refrigerant, for example, can be used. Examples of chlorofluorocarbon refrigerants include hydrofluorocarbon-based (HFC) refrigerants, such as R32, R125, and R134a, and refrigerant mixtures of HFC-based refrigerants, such as R410A, R407c, and R404A. Examples of HFO refrigerants include HFOa234yf, HFOa234ze (E), and HFOa234ze (Z). As other refrigerants, a carbon dioxide ($CO_2$) refrigerant, a hydrocarbon (HC) refrigerant, an ammonia refrigerant, and refrigerants for vapor compression heat pump circuits including refrigerant mixtures of the above-described refrigerants, such as a refrigerant mixture of R32 and HFOa234yf, can be used. Examples of HC refrigerants include propane and isobutane.

Figure 2:
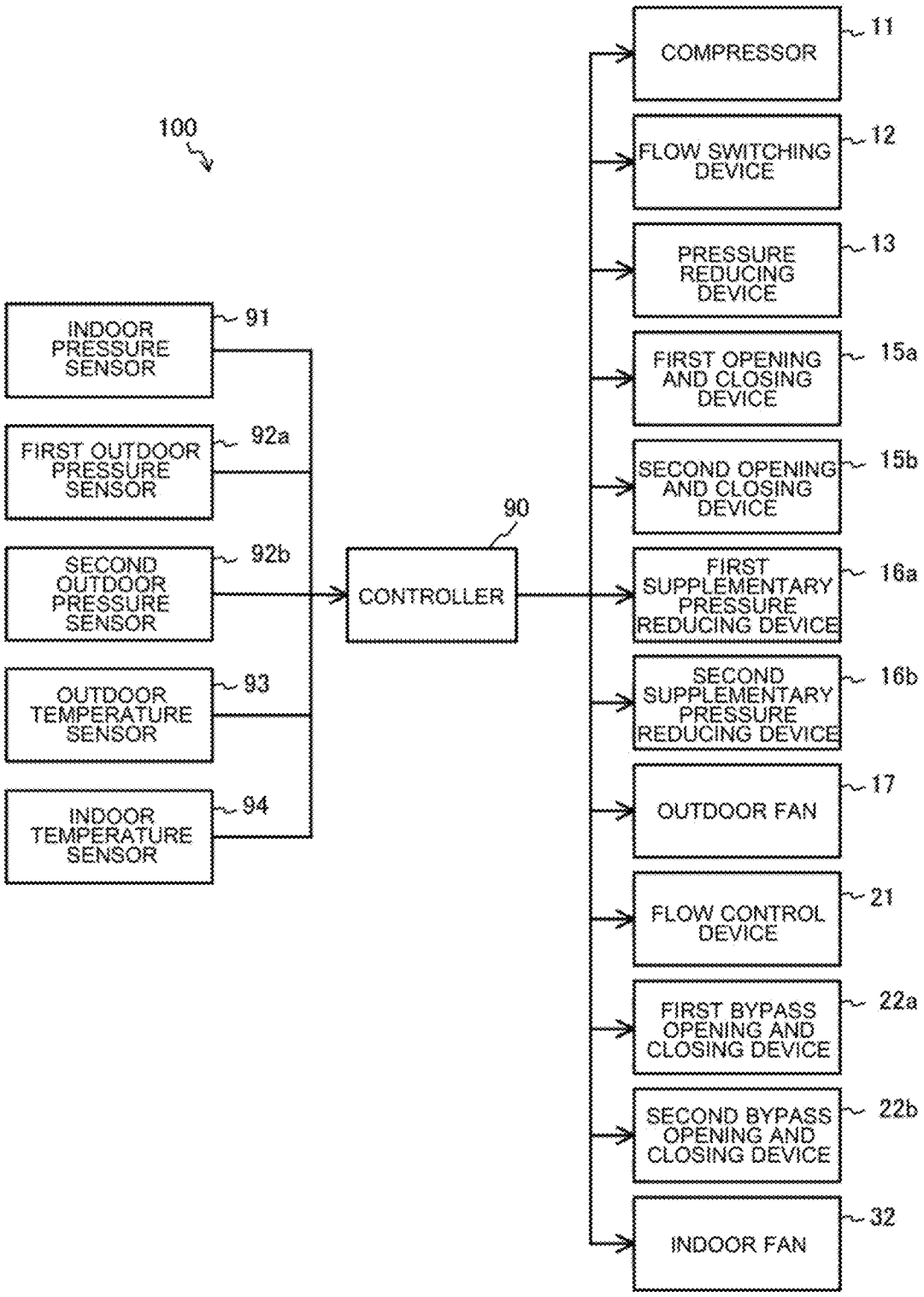
FIG. 2 is a functional block diagram illustrating the air-conditioning apparatus according to Embodiment 1.

FIG. 2 is a functional block diagram illustrating the air-conditioning apparatus 100 according to Embodiment 1. As shown in FIG. 2, the controller 90 is configured to execute each operation mode of the indoor unit 3 and change a set room temperature by controlling the compressor 11, the flow switching device 12, the pressure reducing device 13, the first opening and closing device 15*a* and the second opening and closing device 15*b*, the first supplementary pressure reducing device 16*a* and the second supplementary pressure reducing device 16*b*, the outdoor fan 17, the flow control device 21, the first bypass opening and closing device 22*a* and the second bypass opening and closing device 22*b*, and the indoor fan 32 on the basis of detection results of the indoor pressure sensor 91, the first outdoor pressure sensor 92*a*, the second outdoor pressure sensor 92*b*, the outdoor temperature sensor 93, and the indoor temperature sensor 94.

Figure 3:
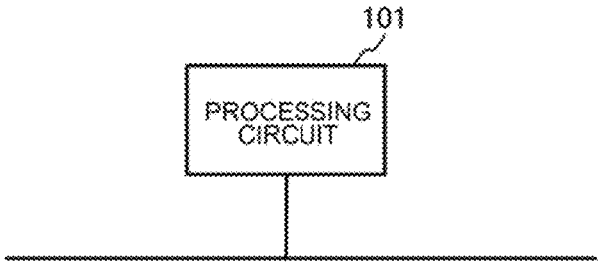
FIG. 3 is a hardware configuration diagram illustrating an example of the configuration of a controller.

Here, an example of hardware for the controller 90 will be described. FIG. 3 is a hardware configuration diagram illustrating an example of the configuration of the controller 90. When each function of a controller 14 is achieved by hardware, the controller 90 is formed as a processing circuit 101, as shown in FIG. 3, and each function is achieved by the processing circuit 101.

When each function is achieved by hardware, the processing circuit 101 corresponds to, for example, a single circuit, a composite circuit, a programmed processor, a parallel programmed processor, an application specific integrated circuit (ASIC), a field-programmable gate array (FPGA), or a combination of those circuits.

Figure 4:
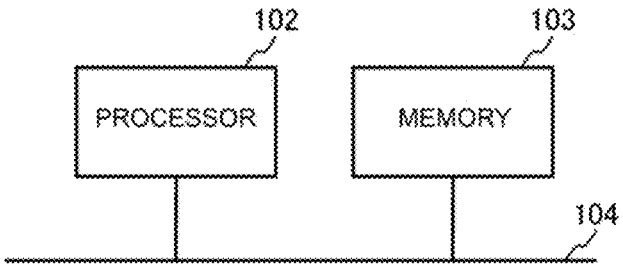
FIG. 4 is a hardware configuration diagram illustrating another example of the configuration of the controller.

In addition, another example of hardware for the controller 90 will be described. FIG. 4 is a hardware configuration diagram illustrating another example of the configuration of the controller 90. When each function of the controller 14 is achieved by software, the controller 90 is formed with a processor 102, such as a central processing unit (CPU), and a memory 103, as shown in FIG. 4. Each function of the controller 90 is achieved by the processor 102 and the memory 103. FIG. 4 indicates that the processor 102 and the memory 103 are connected to each other via a bus 104 such that the processor 102 and the memory 103 are configured to communicate with each other.

Each function of the controller 90 is achieved by software, firmware, or a combination of software and firmware. The software or the firmware is described as a program and is stored in the memory 103. The processor 102 is configured to read out and execute the program stored in the memory 103 to thereby achieve each function.

As the memory 103, a non-volatile semiconductor memory, such as a read only memory (ROM), a flash memory, an erasable and programmable ROM (EPROM), and an electrically erasable and programmable ROM (EEPROM), is used. A volatile semiconductor memory, such as a random access memory (RAM), may be used as the memory 103. In addition, a removal recording medium, such as a magnetic disk, a flexible disk, an optical disc, a compact disc (CD), a mini disc (MD) and a digital versatile disc (DVD), may be used as the memory 103.

The air-conditioning apparatus 100 is configured to operate in a cooling operation mode, a normal heating operation mode, a reverse-cycle defrosting operation mode, and a heating-defrosting operation mode. In the cooling operation mode, the first outdoor heat exchanger 14*a* and the second outdoor heat exchanger 14*b* each operate as a condenser, and the indoor unit 3 cools the inside of the room. In the normal heating operation mode, the first outdoor heat exchanger 14*a* and the second outdoor heat exchanger 14*b* each operate as an evaporator, and the indoor unit 3 heats the inside of the room.

In the reverse-cycle defrosting operation mode, the refrigerant flows through the main circuit 10 in the same direction as that in the cooling operation and thus defrosts the first outdoor heat exchanger 14*a* and the second outdoor heat exchanger 14*b*. The controller 90 is configured to, when a reverse-cycle defrosting shift condition is satisfied, shift the operation mode from the normal heating operation mode to the reverse-cycle defrosting operation mode. The reverse-cycle defrosting shift condition is that, for example, the operation time exceeds a predetermined maximum possible time threshold for the normal heating operation during the normal heating operation mode. In addition, the reverse-cycle defrosting shift condition may be that the first outdoor heat exchanger 14*a* and the second outdoor heat exchanger 14*b* are frosted. Note that, whether or not an outdoor heat exchanger is frosted is determined by a known method, such as a method using a detection result of each sensor. The controller 90 is configured to, when a reverse-cycle defrosting end condition is satisfied, shift the operation mode from the reverse-cycle defrosting operation mode to the normal heating operation mode. The reverse-cycle defrosting end condition is that, for example, the operation is performed in the reverse-cycle defrosting operation mode for a predetermined time period.

In the heating-defrosting operation mode, one of the first outdoor heat exchanger 14*a* and the second outdoor heat exchanger 14*b* is selected as a target to be defrosted and the other one of the first outdoor heat exchanger 14*a* and the second outdoor heat exchanger 14*b* operates as an evaporator and thus keep both defrosting of the outdoor heat exchanger and heating operation. In the heating-defrosting operation mode, the first outdoor heat exchanger 14*a* and the second outdoor heat exchanger 14*b* are defrosted by turns. For example, in the heating-defrosting operation mode, the first outdoor heat exchanger 14*a* operates as an evaporator to perform the heating operation while the second outdoor heat exchanger 14*b* is being defrosted. Then, in the heating-defrosting operation mode, after the defrosting of the second outdoor heat exchanger 14*b* is completed, the second outdoor heat exchanger 14*b* operates as an evaporator to perform the heating operation and the first outdoor heat exchanger 14*a* is defrosted. The controller 90 is configured to, when a heating-defrosting shift condition is satisfied, shift the operation mode from the normal heating operation mode to the heating-defrosting operation mode. The heating-defrosting shift condition is that, for example, the first outdoor heat exchanger 14*a* and the second outdoor heat exchanger 14*b* are frosted during the normal heating operation mode. Note that, whether or not an outdoor heat exchanger is frosted is determined by a known method, such as a method using a detection result of each sensor. In addition, the heating-defrosting shift condition may be that the driving frequency of the compressor 11 falls below a frequency threshold when the temperature of the indoor air approaches the set room temperature, or that a continuous operation time in the normal heating operation mode reaches a predetermined maximum possible time.

The controller 90 is configured to, when a condition for switching is satisfied, switch one outdoor heat exchanger to be defrosted to the other. The condition for switching is that, for example, defrosting of the outdoor heat exchanger to be defrosted is completed or that a predetermined time period has elapsed. In addition, the controller 90 is configured to, when a heating-defrosting end condition is satisfied, shift the operation mode from the heating-defrosting operation mode to the normal heating operation mode. The heating-defrosting end condition is that the temperature of the refrigerant flowing in the first outdoor heat exchanger 14*a* and the temperature of the refrigerant flowing in the second outdoor heat exchanger 14*b* reach a predetermined temperature or higher within a predetermined maximum possible time period. In this case, the controller 90 extends a maximum possible operation time for the normal heating operation mode after the operation mode is returned from the heating-defrosting operation mode. Specifically, the controller 90 is configured to extend the maximum possible operation time for the normal heating operation mode before the operation mode is switched to the reverse-cycle defrosting operation mode or the heating-defrosting operation mode. In addition, the heating-defrosting end condition may be that the operation is performed in the heating-defrosting operation mode for a predetermined time period. In this case, the controller 90 may switch the operation mode to the reverse-cycle defrosting operation mode after the operation mode is switched from the heating-defrosting operation mode to the heating operation mode. The flow of the refrigerant in each operation mode will be described below.

(Cooling Operation Mode)

Figure 5:
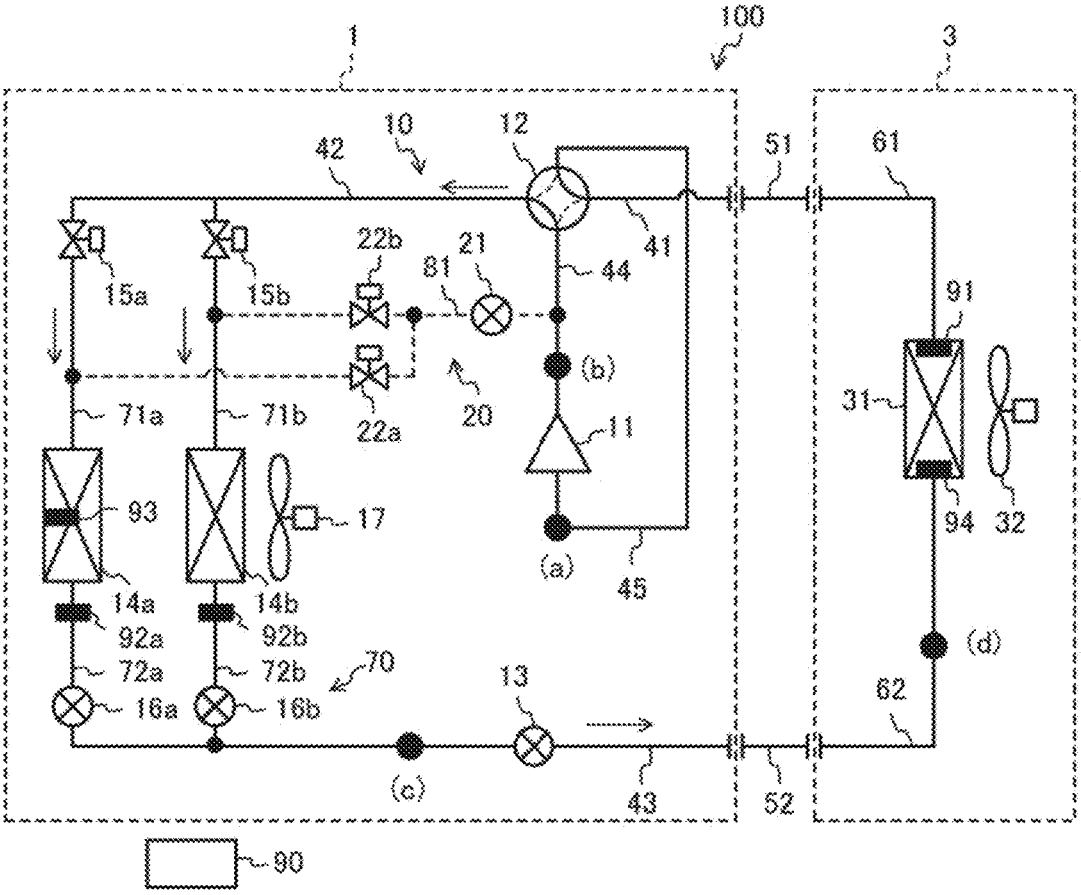
FIG. 5 is a circuit diagram illustrating the flow of refrigerant in a cooling operation according to Embodiment 1.
Figure 6:
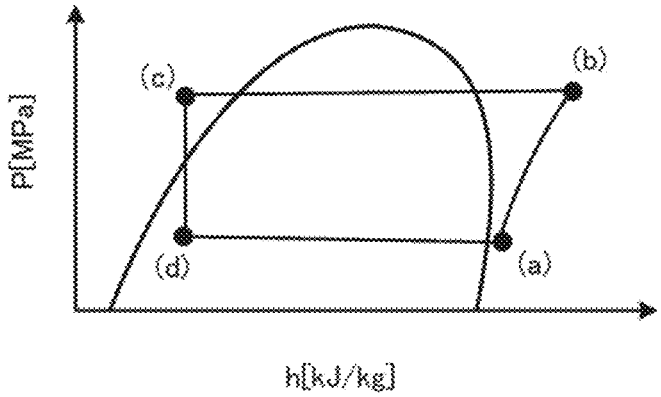
FIG. 6 is a pressure-enthalpy (p-h) diagram in the cooling operation according to Embodiment 1.

The flow of the refrigerant in the cooling operation mode will be described. FIG. 5 is a circuit diagram illustrating the flow of the refrigerant in a cooling operation according to Embodiment 1. FIG. 6 is a p-h diagram in the cooling operation according to Embodiment 1. In FIG. 5, solid lines represent portions in which the refrigerant flows, and broken lines represent portions in which the refrigerant does not flow. In the cooling operation, the controller 90 switches the flow switching device 12 such that the discharge side of the compressor 11 is connected to the first outdoor heat exchanger 14*a* and the second outdoor heat exchanger 14*b* and the suction side of the compressor 11 is connected to the indoor heat exchanger 31. In addition, the controller 90 fully closes the flow control device 21, and fully opens the first opening and closing device 15*a* and the second opening and closing device 15*b*, and the first supplementary pressure reducing device 16*a* and the second supplementary pressure reducing device 16*b*. As shown in FIG. 5, in the cooling operation, the refrigerant sucked into the compressor 11 is compressed by the compressor 11 and then discharged in a high-temperature and high-pressure gas state. For a refrigerant compression process in the compressor 11, the refrigerant is compressed to be heated by an amount corresponding to the adiabatic efficiency of the compressor 11 as compared with adiabatic compression along an isentropic line. The change of the refrigerant at this time corresponds to a line segment extending from point (a) to point (b) in FIG. 6.

The refrigerant in a high-temperature and high-pressure gas state discharged from the compressor 11 passes through the flow switching device 12 and is then divided into two streams flowing into the respective first compressor side pipe 71*a* and second compressor side pipe 71*b*. The divided refrigerant streams pass through the respective first opening and closing device 15*a* and second opening and closing device 15*b* and then flow into the respective first outdoor heat exchanger 14*a* and second outdoor heat exchanger 14*b* each operating as a condenser. In the first outdoor heat exchanger 14*a* and the second outdoor heat exchanger 14*b*, the refrigerant exchanges heat with the outdoor air sent by the outdoor fan 17, and thus condenses and liquefies. The refrigerant is brought into a medium-temperature and high-pressure liquid state. When a pressure loss is taken into account, the change of the refrigerant in the first outdoor heat exchanger 14*a* and the second outdoor heat exchanger 14*b* is represented by a nearly horizontal straight line with a slight tilt as shown by a line segment extending from point (b) to point (c) in FIG. 6. The streams of the refrigerant having condensed in a medium-temperature and high-pressure liquid state join together, and then flows into the pressure reducing device 13. In the pressure reducing device 13, the refrigerant is expanded and reduced in pressure, and is thus brought into a low-temperature and low-pressure two-phase gas-liquid state. The refrigerant in the pressure reducing device 13 changes under a constant enthalpy. The change of the refrigerant at this time corresponds to a vertical line segment extending from point (c) to point (d) in FIG. 6.

The refrigerant in a two-phase gas-liquid state passes through the extension pipe 52 and flows into the indoor heat exchanger 31 operating as an evaporator. In the indoor heat exchanger 31, the refrigerant exchanges heat with the indoor air sent by the indoor fan 32, and thus evaporates and gasifies. At this time, the indoor air is cooled, thus cooling the room. When a pressure loss is taken into account, the change of the refrigerant in the indoor heat exchanger 31 is represented by a nearly horizontal straight line with a slight tilt as shown by a line segment extending from point (d) to point (a) in FIG. 6. The refrigerant having evaporated in a low-temperature and low-pressure gas state passes through the extension pipe 51 and the flow switching device 12, and is then sucked into the compressor 11.

(Normal Heating Operation Mode)

Figure 7:
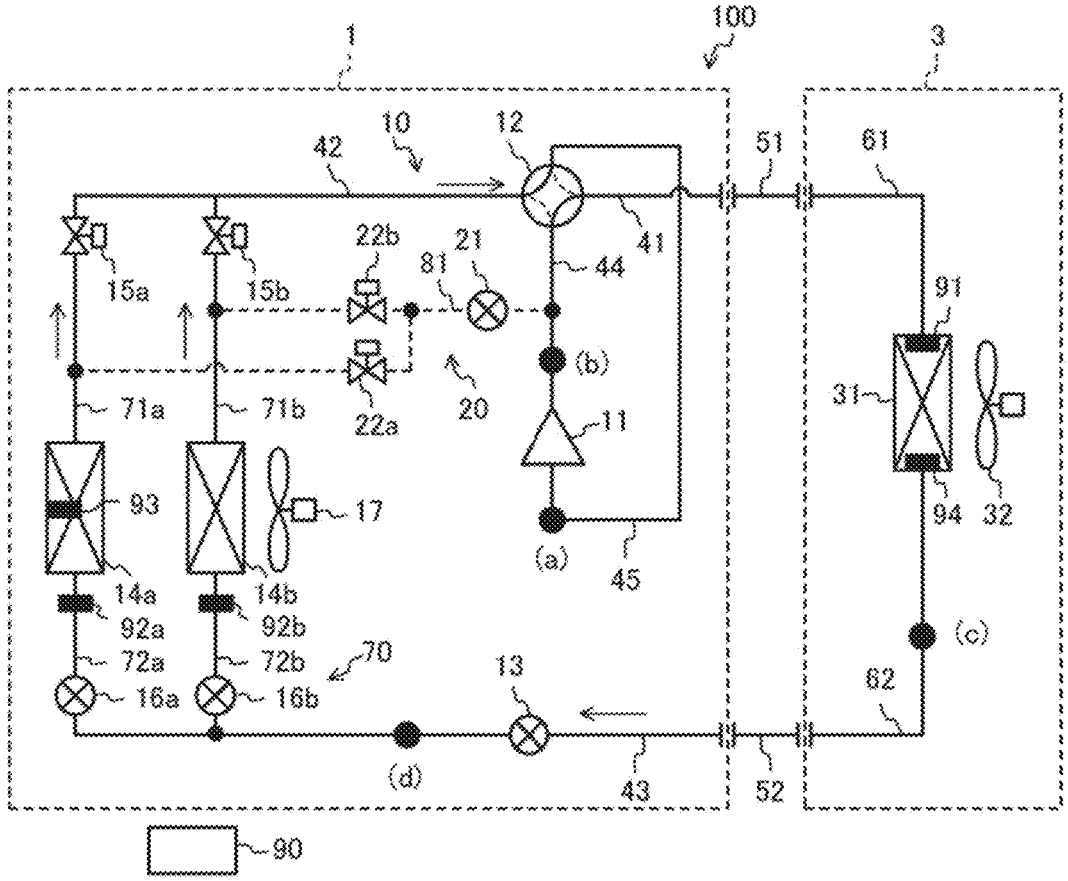
FIG. 7 is a circuit diagram illustrating the flow of the refrigerant in a heating operation according to Embodiment 1.
Figure 8:
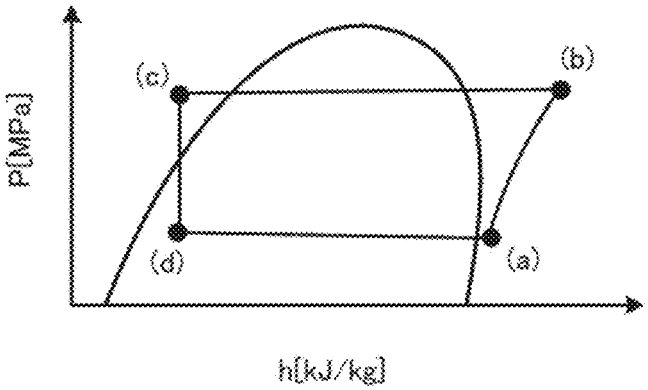
FIG. 8 is a p-h diagram in the heating operation according to Embodiment 1.

The flow of the refrigerant in the normal heating operation mode will be described. FIG. 7 is a circuit diagram illustrating the flow of the refrigerant in a heating operation according to Embodiment 1. FIG. 8 is a p-h diagram in the heating operation according to Embodiment 1. In FIG. 7, solid lines represent portions in which the refrigerant flows, and broken lines represent portions in which the refrigerant does not flow. In the heating operation, the controller 90 switches the flow switching device 12 such that the discharge side of the compressor 11 is connected to the indoor heat exchanger 31 and the suction side of the compressor 11 is connected to the first outdoor heat exchanger 14*a* and the second outdoor heat exchanger 14*b*. In addition, the controller 90 fully closes the flow control device 21, and fully opens the first opening and closing device 15*a* and the second opening and closing device 15*b*, and the first supplementary pressure reducing device 16*a* and the second supplementary pressure reducing device 16*b*. As shown in FIG. 7, in the heating operation, the refrigerant sucked into the compressor 11 is compressed by the compressor 11 and then discharged in a high-temperature and high-pressure gas state. For a refrigerant compression process in the compressor 11, the refrigerant is compressed to be heated by an amount corresponding to the adiabatic efficiency of the compressor 11 as compared with adiabatic compression along an isentropic line. The change of the refrigerant at this time corresponds to a line segment extending from point (a) to point (b) in FIG. 8.

The refrigerant in a high-temperature and high-pressure gas state discharged from the compressor 11 passes through the flow switching device 12 and the extension pipe 51, and then flows into the indoor heat exchanger 31 operating as a condenser. In the indoor heat exchanger 31, the refrigerant exchanges heat with the indoor air. Thus, the refrigerant condenses and liquefies, and is brought into a medium-temperature and high-pressure liquid state. At this time, the indoor air is heated, thus heating the room. When a pressure loss is taken into account, the change of the refrigerant in the indoor heat exchanger 31 is represented by a nearly horizontal straight line with a slight tilt as shown by a line segment extending from point (b) to point (c) in FIG. 8. The refrigerant having condensed in a medium-temperature and high-pressure liquid state passes through the extension pipe 52 and flows into the pressure reducing device 13. In the pressure reducing device 13, the refrigerant is expanded and reduced in pressure, and is thus brought into a medium-pressure two-phase gas-liquid state. The refrigerant in the pressure reducing device 13 changes under a constant enthalpy. The change of the refrigerant at this time corresponds to a vertical line segment extending from point (c) to point (d) in FIG. 8. Note that, the pressure reducing device 13 is controlled such that the degree of subcooling of the refrigerant in a medium-temperature and high-pressure liquid state ranges from approximately 5 K to 20 K.

The refrigerant in a two-phase gas-liquid state is divided into two streams flowing into the respective first outdoor heat exchanger 14*a* and second outdoor heat exchanger 14*b* each operating as an evaporator. The refrigerant in the first outdoor heat exchanger 14*a* and the second outdoor heat exchanger 14*b* exchanges heat with the outdoor air, and thus evaporates and gasifies. When a pressure loss is taken into account, the change of the refrigerant in the first outdoor heat exchanger 14*a* and the second outdoor heat exchanger 14*b* is represented by a nearly horizontal straight line with a slight tilt as shown by a line segment extending from point (d) to point (a) in FIG. 8. The streams of the refrigerant having evaporated in a low-temperature and low-pressure gas state flow into the respective first compressor side pipe 71*a* and second compressor side pipe 71*b*, pass through the respective first opening and closing device 15*a* and second opening and closing device 15*b*, and then join together. The refrigerant then passes through the flow switching device 12 and is then sucked into the compressor 11.

(Reverse-Cycle Defrosting Operation Mode)

The flow of the refrigerant in the reverse-cycle defrosting operation mode will be described. Because the flow of the refrigerant in the reverse-cycle defrosting operation mode is the same as that in the cooling operation mode, the illustration is omitted. However, the reverse-cycle defrosting operation mode differs from the cooling operation mode in that the pressure of the refrigerant is not reduced in the pressure reducing device 13 and that the indoor fan 32 does not operate. The refrigerant in a high-temperature and high-pressure gas state discharged from the compressor 11 passes through the flow switching device 12 and is then divided into two streams flowing into the respective first compressor side pipe 71*a* and second compressor side pipe 71*b*. The divided refrigerant streams pass through the respective first opening and closing device 15*a* and second opening and closing device 15*b* and then flow into the respective first outdoor heat exchanger 14*a* and second outdoor heat exchanger 14*b* from the respective first compressor side pipe 71*a* and second compressor side pipe 71*b*. The refrigerant in a high-temperature and high-pressure gas state exchanges heat with the frost that attaches on the first outdoor heat exchanger 14*a* and the second outdoor heat exchanger 14*b*, thus melting the frost.

(Heating-Defrosting Operation Mode)

Figure 9:
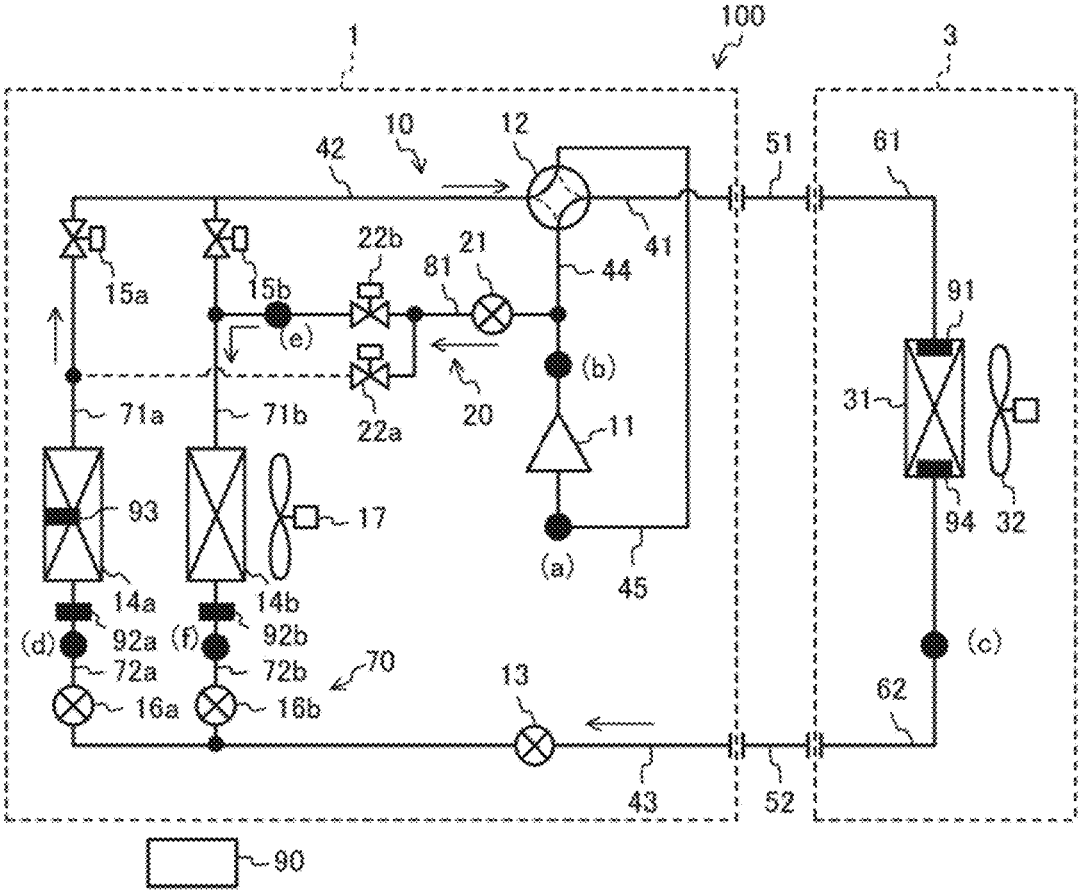
FIG. 9 is a circuit diagram illustrating the flow of the refrigerant in a heating-defrosting operation according to Embodiment 1.
Figure 10:
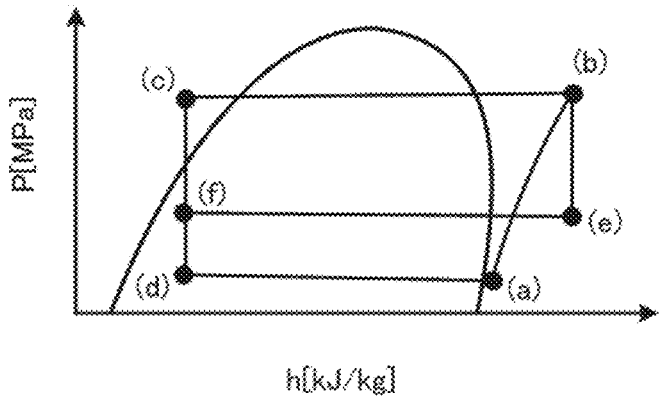
FIG. 10 is a p-h diagram in the heating-defrosting operation according to Embodiment 1.

The flow of the refrigerant in the heating-defrosting operation mode will be described. FIG. 9 is a circuit diagram illustrating the flow of the refrigerant in a heating-defrosting operation according to Embodiment 1. FIG. 10 is a p-h diagram in the heating-defrosting operation according to Embodiment 1. In FIG. 9, solid lines represent portions in which the refrigerant flows, and broken lines represent portions in which the refrigerant does not flow. In the heating-defrosting operation, the controller 90 switches the flow switching device 12 such that the discharge side of the compressor 11 is connected to the indoor heat exchanger 31 and the suction side of the compressor 11 is connected to the first outdoor heat exchanger 14*a* and the second outdoor heat exchanger 14*b*. In addition, the controller 90 opens the flow control device 21. In the heating-defrosting operation mode, one of the first outdoor heat exchanger 14*a* and the second outdoor heat exchanger 14*b* is selected as a target to be defrosted, and is defrosted. The other one of the first outdoor heat exchanger 14*a* and the second outdoor heat exchanger 14*b* operates as an evaporator and thus continues the heating operation. The controller 90 alternatively switches between open and closed states of the first opening and closing device 15*a* and the second opening and closing device 15*b*, and between open and closed states of the first bypass opening and closing device 22*a* and the second bypass opening and closing device 22*b*. Thus, the first outdoor heat exchanger 14*a* and the second outdoor heat exchanger 14*b* are alternatively selected as the target to be defrosted. The flow of the refrigerant is switched in response to switching between the outdoor heat exchanger being defrosted and the outdoor heat exchanger operating as an evaporator.

In FIG. 9, a case is described where the second outdoor heat exchanger 14*b* is selected as a target to be defrosted and the first outdoor heat exchanger 14*a* operates as an evaporator and thus continues the heating operation. In this case, the controller 90 fully opens the first opening and closing device 15*a* and fully closes the second opening and closing device 15*b*. The controller 90 fully closes the first bypass opening and closing device 22*a* and fully opens the second bypass opening and closing device 22*b*. In addition, the controller 90 controls the opening degree of the second supplementary pressure reducing device 16*b* connected to the second outdoor heat exchanger 14*b* such that a saturation temperature converted from the pressure of the second outdoor heat exchanger 14*b* being defrosted ranges from approximately 0 degrees to 10 degrees C. The controller 90 fully opens the first supplementary pressure reducing device 16*a* connected to the first outdoor heat exchanger 14*a* operating as an evaporator. First, the flow of the refrigerant in the main circuit 10 will be described. As shown in FIG. 9, in the defrosting-heating operation, the refrigerant sucked into the compressor 11 is compressed by the compressor 11 and then discharged in a high-temperature and high-pressure gas state. For a refrigerant compression process in the compressor 11, the refrigerant is compressed to be heated by an amount corresponding to the adiabatic efficiency of the compressor 11 as compared with adiabatic compression along an isentropic line. The change of the refrigerant at this time corresponds to a line segment extending from point (a) to point (b) in FIG. 10.

Part of the refrigerant in a high-temperature and high-pressure gas state discharged from the compressor 11 passes through the flow switching device 12 and the extension pipe 51, and then flows into the indoor heat exchanger 31 operating as a condenser. In the indoor heat exchanger 31, the refrigerant exchanges heat with the indoor air. Thus, the refrigerant condenses and liquefies, and is brought into a medium-temperature and high-pressure liquid state. At this time, the indoor air is heated, thus heating the room. When a pressure loss is taken into account, the change of the refrigerant in the indoor heat exchanger 31 is represented by a nearly horizontal straight line with a slight tilt as shown by a line segment extending from point (b) to point (c) in FIG. 10. The refrigerant having condensed in a medium-temperature and high-pressure liquid state passes through the extension pipe 52 and then flows into the pressure reducing device 13 and the first supplementary pressure reducing device 16*a*. In the pressure reducing device 13 and the first supplementary pressure reducing device 16*a*, the refrigerant is expanded and reduced in pressure, and is thus brought into a medium-pressure two-phase gas-liquid state. The refrigerant in the pressure reducing device 13 changes under a constant enthalpy. The change of the refrigerant at this time corresponds to a vertical line segment extending from point (c) to point (d) in FIG. 10.

The refrigerant in a two-phase gas-liquid state does not flow through the second outdoor heat exchanger 14*b* being defrosted, but flows into the first outdoor heat exchanger 14*a* operating as an evaporator. In the first outdoor heat exchanger 14*a*, the refrigerant exchanges heat with the outdoor air and thus evaporates and gasifies. When a pressure loss is taken into account, the change of the refrigerant in the first outdoor heat exchanger 14*a* is represented by a nearly horizontal straight line with a slight tilt as shown by a line segment extending from point (d) to point (a) in FIG. 10. The refrigerant having evaporated in a low-temperature and low-pressure gas state flows into the first compressor side pipe 71*a*, passes through the first opening and closing device 15*a* and then flow switching device 12, and is then sucked into the compressor 11.

Next, the flow of the refrigerant in the bypass circuit 20 will be described. Part of the refrigerant in a high-temperature and high-pressure gas state discharged from the compressor 11 flows through the bypass pipe 81 and flows into the flow control device 21. In the flow control device 21, the refrigerant is reduced in pressure. The refrigerant in the flow control device 21 changes under a constant enthalpy. The change of the refrigerant at this time corresponds to a vertical line segment extending from point (b) to point (e) in FIG. 10. The refrigerant reduced in pressure by the flow control device 21 passes through the second bypass opening and closing device 22*b*, flows through the second compressor side pipe 71*b*, and then flows into the second outdoor heat exchanger 14*b* being defrosted. The refrigerant flowing in the second outdoor heat exchanger 14*b* exchanges heat with the frost that attaches on the second outdoor heat exchanger 14*b* and is thus cooled. As described above, the refrigerant in a high-temperature and high-pressure gas state discharged from the compressor 11 flows into the second outdoor heat exchanger 14*b* and melts the frost that attaches on the second outdoor heat exchanger 14*b*. The change of the refrigerant at this time corresponds to a line segment extending from point (e) to point (f) in FIG. 10. The refrigerant used to defrost the second outdoor heat exchanger 14*b* and flowing out of the second outdoor heat exchanger 14*b* passes through the second supplementary pressure reducing device 16*b* and then joins the refrigerant flowing in the main circuit 10. The merged refrigerant flows into the first outdoor heat exchanger 14*a* operating as an evaporator and thus evaporates.

In a case where the first outdoor heat exchanger 14*a* is selected as a target to be defrosted and the second outdoor heat exchanger 14*b* operates as an evaporator and thus continues heating, the open and closed states of the first opening and closing device 15*a* and the second opening and closing device 15*b*, the open and closed states of the first bypass opening and closing device 22*a* and the second bypass opening and closing device 22*b*, and the open and closed states of the first supplementary pressure reducing device 16*a* and the second supplementary pressure reducing device 16*b* are reversed from those in the above case. Thus, the detailed description is omitted.

An operation of the controller 90 controlling the flow control device 21 in the heating-defrosting operation mode will be described below. First, when the normal heating operation mode is switched to the heating-defrosting operation mode, the controller 90 sets the opening degree of the flow control device 21 to an initial opening degree $\text{Pulse}_{ini}$ such that the refrigerant corresponding to an increased flow rate flows through the first outdoor heat exchanger 14*a* or the second outdoor heat exchanger 14*b* selected as a target to be defrosted.

Specifically, it is known that the higher the driving frequency of the compressor 11 and the density of the refrigerant become, the higher the flow rate of the refrigerant becomes, and that the density of the refrigerant is directly proportional to the evaporating pressure. Therefore, when the operation mode is switched to the heating-defrosting operation mode, the larger the reduction in the evaporating pressure of the outdoor heat exchanger operating as an evaporator and the smaller the increase in the driving frequency of the compressor 11, the less the flow rate becomes for the refrigerant flowing in the first outdoor heat exchanger 14*a* or the second outdoor heat exchanger 14*b* to be defrosted. Thus, when the normal heating operation mode is switched to the heating-defrosting operation mode, the controller 90 sets the initial opening degree $\text{Pulse}_{ini}$ on the basis of the evaporating pressure of the outdoor heat exchanger operating as an evaporator and the driving frequency of the compressor 11. Specifically, when a reduction in the evaporating pressure of the outdoor heat exchanger operating as an evaporator becomes larger and an increase in the driving frequency of the compressor 11 becomes less, the initial opening degree $\text{Pulse}_{ini}$ of the flow control device 21 is set to a smaller value. Note that, the first outdoor pressure sensor 92*a* or the second outdoor pressure sensor 92*b* that detects the pressure of the refrigerant flowing in the first outdoor heat exchanger 14*a* or the second outdoor heat exchanger 14*b* operating as an evaporator, serves as a sensor that detects the evaporating pressure.

Then, when switching between the outdoor heat exchangers to be defrosted in the heating-defrosting operation mode, the controller 90 refers the condensing temperature of the indoor heat exchanger 31 and sets the opening degree of the flow control device 21 to an opening degree obtained by correcting the initial opening degree $\text{Pulse}_{ini}$. The controller 90 calculates the condensing temperature of the indoor heat exchanger 31 by converting the condensing pressure of the indoor heat exchanger 31 detected by the indoor pressure sensor 91. Specifically, the controller 90 adjusts the opening degree of the flow control device 21 on the basis of a high-low relation between a first condensing temperature TC obtained when the target to be defrosted is switched from one to the other and a second condensing temperature $\text{TC}_{heat}$ obtained when the normal heating operation mode is switched to the heating-defrosting operation mode. That is, when the first condensing temperature TC is greater than the second condensing temperature $\text{TC}_{heat}$, the controller 90 increases the opening degree of the flow control device 21 larger than the initial opening degree $\text{Pulse}_{ini}$. When the first condensing temperature TC is less than the second condensing temperature $\text{TC}_{heat}$, the controller 90 reduces the opening degree of the flow control device 21 smaller than the initial opening degree $\text{Pulse}_{ini}$. More specifically, the controller 90 may correct the opening degree by use of the following equation. It is understood that the controller 90 adjusts the opening degree of the flow control device 21 not to be lower than a predetermined opening degree lower limit. The opening degree lower limit means a minimum possible opening degree at which all frost is removed, and is determined from tests by use of an actual apparatus.

$$\text{Pulse} = \text{Pulse}_{ini} \times (TC - TA)/(TC_{heat} - TA_{heat})$$

Here, Pulse is the opening degree of the flow control device 21 to be newly set. TA is the suction temperature of the indoor unit 3 when the target to be defrosted is switched in the heating-defrosting operation mode. $\text{TA}_{heat}$ is the suction temperature obtained when the normal heating operation mode is switched to the heating-defrosting operation mode. Note that, the second condensing temperature $\text{TC}_{heat}$ and the suction temperature of $\text{TA}_{heat}$ obtained when the normal heating operation mode is switched to the heating-defrosting operation mode are stored in the controller 90 at the timing of the switching.

Figure 11:
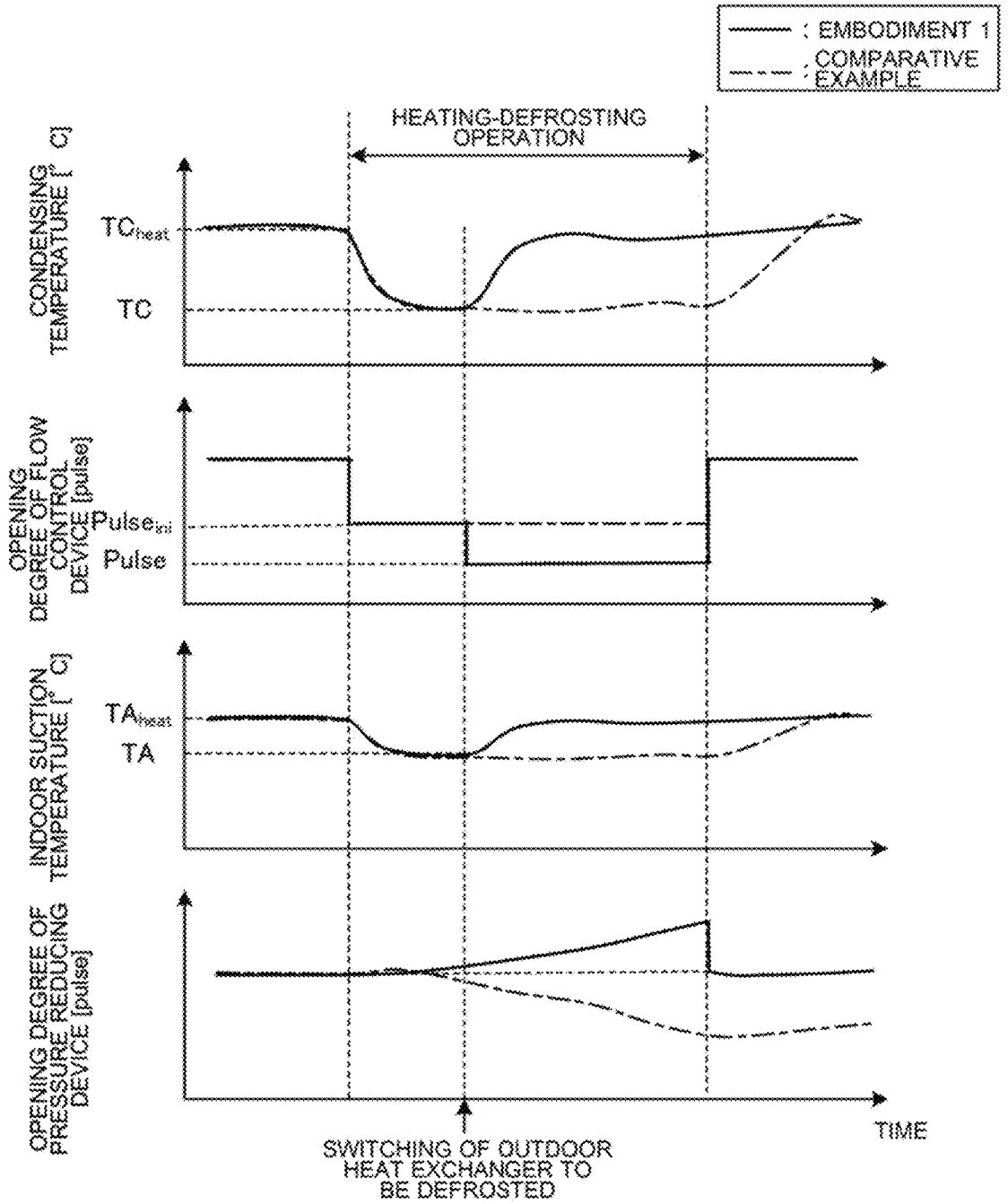
FIG. 11 is a diagram explaining a heating-defrosting operation mode according to Embodiment 1.

FIG. 11 is a diagram explaining the heating-defrosting operation mode according to Embodiment 1. In FIG. 11, the condensing temperature, the opening degree of the flow control device 21, the indoor suction temperature, and the opening degree of the pressure reducing device 13 are represented in time series by four graphs, each including a case of Embodiment 1 and a case of a comparative example. The time represented by the horizontal axis is identical among the graphs. FIG. 11 illustrates a case where the first condensing temperature TC obtained when the target to be defrosted is switched from one to the other is lower than the second condensing temperature $TC_{heat}$ obtained when the normal heating operation mode is switched to the heating-defrosting operation mode. The comparative example represents a case where the opening degree of the flow control device 21 is not corrected on the basis of the condensing temperature of the indoor heat exchanger 31 in Embodiment 1 described above.

In the heating-defrosting operation mode, the flow rate of the refrigerant is sometimes reduced smaller than expected because of deterioration in the volume efficiency of the compressor 11 caused by an increase in the difference between high and low pressures in the refrigeration cycle. At this time, as shown by the comparative example in FIG. 11, when the opening degree of the flow control device 21 is kept to the initial opening degree $Pulse_{ini}$, the condensing temperature may be lowered, causing a reduction in the heating capacity. In the comparative example, a reduction in the heating capacity results in a reduction in the indoor suction temperature in the heating-defrosting operation mode.

In contrast, in Embodiment 1, the opening degree of the flow control device 21 is corrected on the basis of the condensing temperature of the indoor heat exchanger 31. Specifically, in FIG. 11, because the first condensing temperature TC obtained when the target to be defrosted is switched from one to the other becomes lower than the second condensing temperature $TC_{heat}$ obtained when the normal heating operation mode is switched to the heating-defrosting operation mode, the controller 90 reduces the opening degree Pulse of the flow control device 21 smaller than the initial opening degree $Pulse_{ini}$. Thus, in Embodiment 1, the condensing temperature before start of the heating-defrosting operation mode is maintained, and thus fluctuation of the heating capacity when switching from the normal heating operation is prevented. In Embodiment 1, by preventing fluctuation of the heating capacity, a reduction in the indoor suction temperature is more effectively prevented in the heating-defrosting operation mode compared with the comparative example.

Furthermore, in the heating-defrosting operation mode, when the opening degree of the flow control device 21 is reduced, the controller 90 increases the opening degree of the pressure reducing device 13 as the discharge temperature increases. When the operation mode is returned to the normal heating operation mode while the opening degree of the pressure reducing device 13 is kept large, the condensing temperature may be reduced because the difference between high and low pressures is not large enough. For this reason, as shown in FIG. 11, the controller 90 may change the opening degree of the pressure reducing device 13 to the opening degree of the pressure reducing device 13 that is used just before the operation mode is shifted to heating-defrosting operation mode, when the operation mode is returned to the normal heating operation mode. Thus, when the operation mode is returned to the normal heating operation mode, the difference between high and low pressures is secured and a reduction in the condensing pressure is prevented.

Because the flow control device 21 is controlled by the controller 90 in this way, the heating capacity is prevented from fluctuating in the heating operation even during the heating-defrosting operation mode or even when the flow rate of the refrigerant is reduced when the operation mode is returned to the normal heating operation mode, and thus the temperature of the air blown out into the room is maintained.

Furthermore, when the first outdoor heat exchanger 14*a* and the second outdoor heat exchanger 14*b* are obtained from a single outdoor heat exchanger by dividing into an upper outdoor heat exchanger and a lower outdoor heat exchanger, the operation is performed in the heating-defrosting operation mode as follows. That is, the outdoor heat exchanger, among the first outdoor heat exchanger 14*a* and the second outdoor heat exchanger 14*b*, provided on the lower side is set as a target to be defrosted first, and then the outdoor heat exchanger provided on the upper side is set as a target to be defrosted, and all surfaces are thus defrosted. As a result, water resulted from defrosting of the upper side outdoor heat exchanger is prevented from attaching to the frost on the lower side outdoor heat exchanger. In addition, after the outdoor heat exchanger provided on the upper side is defrosted, the lower outdoor heat exchanger may be defrosted again. Thus, when water resulted from defrosting of the upper side outdoor heat exchanger runs down the lower side outdoor heat exchanger operating as an evaporator, the water is prevented from freezing. A case where the first outdoor heat exchanger 14*a* and the second outdoor heat exchanger 14*b* independent from each other are arranged top and bottom, that is, a case where one of the first outdoor heat exchanger 14*a* and the second outdoor heat exchanger 14*b* is provided below the other outdoor heat exchanger has the same effect as that of the case where the single outdoor heat exchanger is divided.

Note that, when the lower side outdoor heat exchanger is defrosted for the second time, the lower outdoor heat exchanger has less frost formation than for the first time. For this reason, the opening degree of the flow control device 21 when the lower side outdoor heat exchanger is defrosted for the second time may be smaller than the opening degree of the flow control device 21 when the lower side outdoor heat exchanger is defrosted for the first time and may be smaller than the opening degree of the flow control device 21 when the upper side outdoor heat exchanger is defrosted. In addition, a time period during which the lower side outdoor heat exchanger is defrosted for the second time may be shorter than a time period during which the lower side outdoor heat exchanger is defrosted for the first time and may be shorter than a time period during which the upper side outdoor heat exchanger is defrosted.

Figure 12:
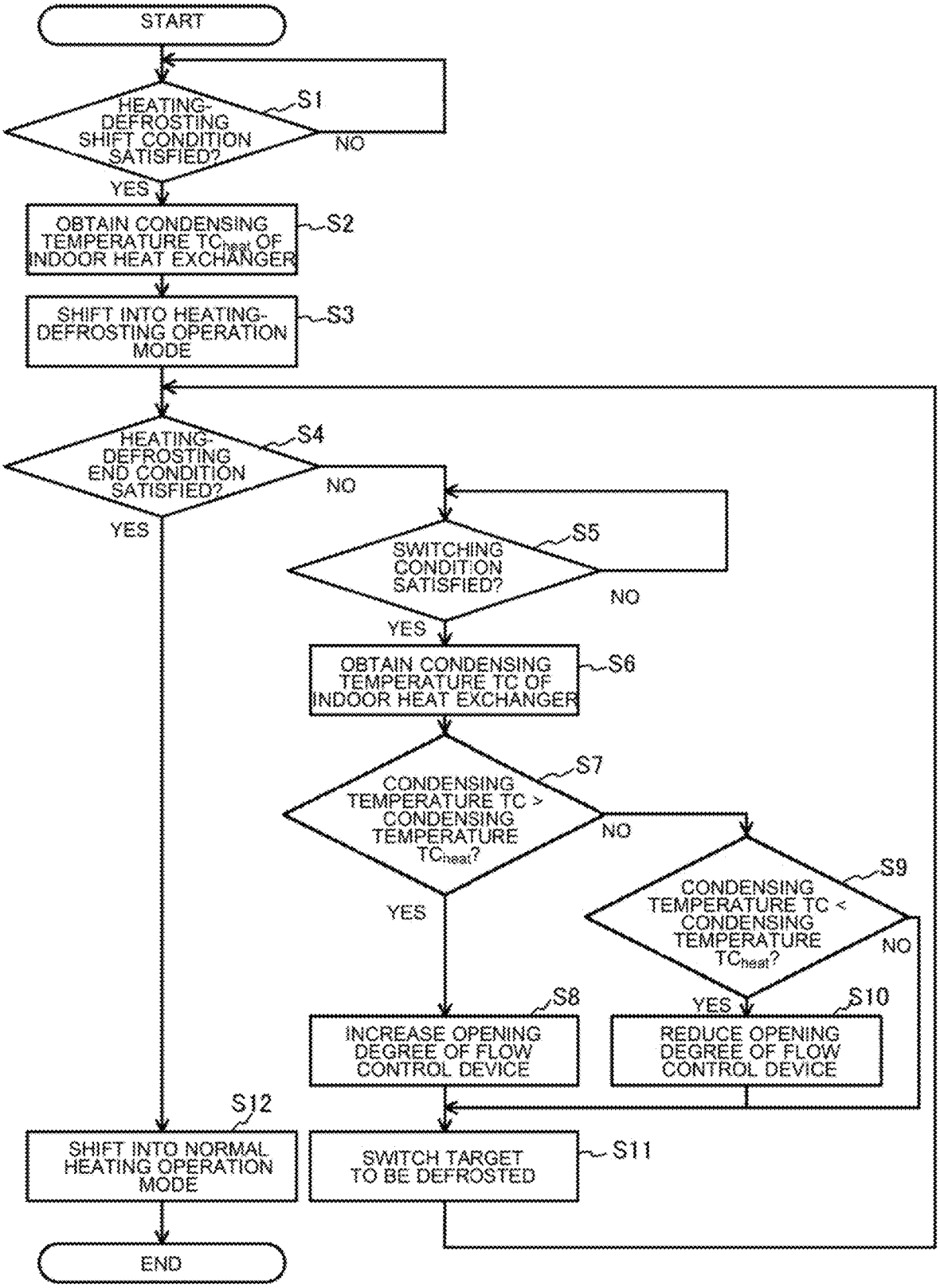
FIG. 12 is a flowchart illustrating an operation of a controller 90 according to Embodiment 1.

FIG. 12 is a flowchart illustrating an operation of the controller 90 according to Embodiment 1. An operation of the controller 90 from shifting the operation mode from the normal heating operation mode to the heating-defrosting operation mode to returning the operation mode to the normal heating operation again will be described with reference to FIG. 12. Note that, in the following operation procedure, a description of the control of the first bypass opening and closing device 22*a* and the second bypass opening and closing device 22*b* is omitted. First, the controller 90 determines whether or not the condition for shifting into the heating-defrosting operation mode is satisfied during execution in the normal heating operation mode (step S1). When it is determined that the condition for shifting into the heating-defrosting operation mode is not satisfied (NO in step S1), the controller 90 maintains the normal heating operation mode until the heating-defrosting shift condition is satisfied and, during this period, periodically performs the processing of step S1. When the heating-defrosting shift condition is satisfied (YES in step S1), the controller 90 obtains the second condensing temperature $TC_{heat}$ of the indoor heat exchanger 31 (step S2), and operates each device such that the operation mode is shifted into the heating-defrosting operation mode (step S3). At this time, the opening degree of the flow control device 21 is set to the initial opening degree $Pulse_{ini}$.

The controller 90 determines whether or not the heating-defrosting end condition is satisfied during execution in the heating-defrosting operation mode (step S4). When the heating-defrosting end condition is not satisfied (NO in step S4), the controller 90 determines whether or not the condition for switching the target to be defrosted is satisfied in the heating-defrosting operation mode (step S5). When the defrost target switching condition is not satisfied, the controller 90 continues the operation in the heating-defrosting operation mode in which one of the outdoor heat exchangers is defrosted until the defrost target switching condition is satisfied and, during this period, periodically performs the processing of step S5. When the defrost target switching condition is satisfied (YES in step S5), the first condensing temperature TC of the indoor heat exchanger 31 is obtained (step S6).

Then, the controller 90 determines whether or not the first condensing temperature TC of the indoor heat exchanger 31 is higher than the second condensing temperature $TC_{heat}$ (step S7). When the first condensing temperature TC of the indoor heat exchanger 31 is higher than the second condensing temperature $TC_{heat}$ (YES in step S7), the controller 90 increases the opening degree of the flow control device 21 larger than the initial opening degree $Pulse_{ini}$ (step S8). When the first condensing temperature TC of the indoor heat exchanger 31 is lower than or equal to the second condensing temperature $TC_{heat}$ (NO in step S7), the controller 90 determines whether or not the first condensing temperature TC of the indoor heat exchanger 31 is lower than the condensing temperature $TC_{heat}$ (step S9). When the first condensing temperature TC of the indoor heat exchanger 31 is lower than the second condensing temperature $TC_{heat}$ (YES in step S9), the opening degree of the flow control device 21 is reduced smaller than the initial opening degree $Pulse_{ini}$ (step S10). Note that, when the determination is NO in step S7 and step S8, that is, when the first condensing temperature TC of the indoor heat exchanger 31 is equal to the second condensing temperature $TC_{heat}$, the opening degree of the flow control device 21 is not changed from the initial opening degree $Pulse_{ini}$. When correction of the opening degree of the flow control device 21 is completed, the controller 90 operates each device such that the target being defrosted is switched from one to the other (step S11), and then determines again whether or not the condition for ending the heating-defrosting operation mode is satisfied (step S4).

When the heating-defrosting end condition is satisfied (YES in step S4), the controller 90 operates each device such that the operation mode is switched to the normal heating operation mode (step S12). Note that, the order of the processing described above is merely one example. For example, the order may be exchanged between steps S2 and S3, the order may be exchanged between the steps S8 and S11, and the order may be exchanged between the steps S10 and S11.

As described above, the controller 90 of Embodiment 1 is configured to, when, during the heating-defrosting operation mode, the condensing temperature becomes lower than the condensing temperature obtained when the heating operation mode is switched to the heating-defrosting operation mode, reduce the opening degree of the flow control device 21 smaller than the initial opening degree. Thus, the flow rate of the refrigerant supplied to the indoor heat exchanger 31 is increased. Therefore, in the heating-defrosting operation mode, the air-conditioning apparatus 100 of Embodiment 1 is configured to prevent temperature of air blown out into the room from changing from that in the heating operation performed just before the operation mode is switched to the heating-defrosting operation mode, and is thus configured to improve comfortability in the room.

Although the embodiment of the present disclosure is described above, the present disclosure is not limited to the configuration of the abovementioned embodiment, and various modifications or combinations are possible within the technical idea of the present disclosure. For example, the first supplementary pressure reducing device 16*a* and the second supplementary pressure reducing device 16*b* may be omitted in the air-conditioning apparatus 100.

REFERENCE SIGNS LIST

1: outdoor unit, 3: indoor unit, 10: main circuit, 11: compressor, 12: flow switching device, 13: pressure reducing device, 14*a*: first outdoor heat exchanger, 14*b*: second outdoor heat exchanger, 15*a*: first opening and closing device, 15*b*: second opening and closing device, 16*a*: first supplementary pressure reducing device, 16*b*: second supplementary pressure reducing device, 17: outdoor fan, 20: bypass circuit, 21: flow control device, 22*a*: first bypass opening and closing device, 22*b*: second bypass opening and closing device, 31: indoor heat exchanger, 32: indoor fan, 41, 42, 43: outdoor unit pipe, 44: discharge pipe, 45: suction pipe, 51, 52: extension pipe, 61, 62: indoor unit pipe, 70: parallel pipe, 71*a*: first compressor side pipe, 71*b*: second compressor side pipe, 72*a*: first pressure reducing device side pipe, 72*b*: second pressure reducing device side pipe, 81: bypass pipe, 90: controller, 91: indoor pressure sensor, 92*a*: first outdoor pressure sensor, 92*b*: second outdoor pressure sensor, 93: outdoor temperature sensor, 94: indoor temperature sensor, 100: air-conditioning apparatus, 101: processing circuit, 102: processor, 103: memory, 104: bus

The invention claimed is:

1. An air-conditioning apparatus comprising:

a circuit in which a compressor, a flow switching device that includes a four-way valve, an indoor heat exchanger, a pressure reducing device that includes a pressure reducing valve or an expansion valve, and a first outdoor heat exchanger and a second outdoor heat exchanger connected in parallel with each other are connected by pipes and through which refrigerant flows;

a bypass circuit having a bypass pipe that connects a discharge side of the compressor to a point between the flow switching device and the first outdoor heat exchanger and to a point between the flow switching device and the second outdoor heat exchanger and allows part of the refrigerant discharged from the compressor to be diverted into the bypass pipe and flow through the bypass pipe;

a flow control device that includes a flow control valve and is provided to the bypass pipe and configured to adjust a flow rate of the refrigerant flowing through the bypass pipe; and a controller configured to control the flow switching device, the pressure reducing device, and the flow control device, the air-conditioning apparatus being configured to operate in a normal heating operation mode in which the first outdoor heat exchanger and the second outdoor heat exchanger operate as evaporators and in a heating-defrosting operation mode in which one of the first outdoor heat exchanger and the second outdoor heat exchanger is defrosted as a target to be defrosted and an other of the first outdoor heat exchanger and the second outdoor heat exchanger operates as an evaporator, the controller being configured to, during the heating-defrosting operation mode, compare a first condensing temperature obtained when the target to be defrosted is switched from the one of the first outdoor heat exchanger and the second outdoor heat exchanger to the other of the first outdoor heat exchanger and the second outdoor heat exchanger with a second condensing temperature obtained when an operation mode is switched from the normal heating operation mode to the heating-defrosting operation mode, reduce, when the first condensing temperature is less than the second condensing temperature, an opening degree of the flow control device smaller than an initial opening degree being set when the normal heating operation mode is shifted to the heating-defrosting operation mode, and increase, when the first condensing temperature is greater than the second condensing temperature, the opening degree of the flow control device larger than the initial opening degree.

2. The air-conditioning apparatus of claim 1, wherein the controller is configured to, when the heating-defrosting operation mode is switched to the normal heating operation mode, change an opening degree of the pressure reducing device to an opening degree of the pressure reducing device that is used just before the operation mode is switched to the heating-defrosting operation mode.

3. The air-conditioning apparatus of claim 1, wherein the controller is configured to adjust the opening degree of the flow control device such that the opening degree of the flow control device does not become lower than a predetermined opening degree lower limit.

4. The air-conditioning apparatus of claim 1, wherein one of the first outdoor heat exchanger and the second outdoor heat exchanger is provided below an other of the first outdoor heat exchanger and the second outdoor heat exchanger, and wherein the controller is configured to, in the heating-defrosting operation mode, set the target to be defrosted such that the one of the first outdoor heat exchanger and the second outdoor heat exchanger provided below, the other of the first outdoor heat exchanger and the second outdoor heat exchanger provided above, and the one of the first outdoor heat exchanger and the second outdoor heat exchanger provided below are defrosted in this order.

5. The air-conditioning apparatus of claim 4, wherein the controller is configured to reduce the opening degree of the flow control device when the one of the first outdoor heat exchanger and the second outdoor heat exchanger provided below is defrosted for a second time smaller than the opening degree of the flow control device when the one of the first outdoor heat exchanger and the second outdoor heat exchanger provided below is defrosted for a first time.

6. The air-conditioning apparatus of claim 4, wherein the controller is configured to set a time for defrosting the one of the first outdoor heat exchanger and the second outdoor heat exchanger provided below for the first time shorter than a time for defrosting the one of the first outdoor heat exchanger and the second outdoor heat exchanger provided below for the second time or shorter than a time for defrosting the other one of the first outdoor heat exchanger and the second outdoor heat exchanger provided above.

7. The air-conditioning apparatus of claim 1, further comprising:

an outdoor pressure sensor provided to the first outdoor heat exchanger or the second outdoor heat exchanger, the outdoor pressure sensor being configured to detect an evaporating pressure of the refrigerant in the first outdoor heat exchanger or the second outdoor heat exchanger during a heating operation, wherein the controller is configured to, when the normal heating operation mode is switched to the heating-defrosting operation mode, set the initial opening degree on a basis of the evaporating pressure of the first outdoor heat exchanger or the second outdoor heat exchanger detected by the outdoor pressure sensor and a driving frequency of the compressor.

8. The air-conditioning apparatus of claim 1, further comprising:

an indoor pressure sensor provided to the indoor heat exchanger, the indoor pressure sensor being configured to detect a condensing pressure of the refrigerant in the indoor heat exchanger during a heating operation, wherein the controller is configured to convert the condensing pressure detected by the indoor pressure sensor and to calculate the first condensing temperature and the second condensing temperature.

* * * * *